US007088944B2

(12) United States Patent
Himes

(10) Patent No.: US 7,088,944 B2
(45) Date of Patent: Aug. 8, 2006

(54) DEVELOPER CARTRIDGE INCLUDING RADIALLY EXTENDING DRIVE LUG

(76) Inventor: William D. Himes, 401 Volvo Pkwy., Chesapeake, VA (US) 23320

( * ) Notice: Subject to any disclaimer, the term of this patent is extended or adjusted under 35 U.S.C. 154(b) by 0 days.

(21) Appl. No.: 10/793,982

(22) Filed: Mar. 5, 2004

(65) Prior Publication Data

US 2005/0196197 A1 Sep. 8, 2005

(51) Int. Cl.
*G03G 15/08* (2006.01)

(52) U.S. Cl. ..... 399/262

(58) Field of Classification Search ..... 399/262, 399/258

See application file for complete search history.

(56) References Cited

U.S. PATENT DOCUMENTS

| | | | | |
|---|---|---|---|---|
| D362,678 | S | 9/1995 | Ishibashi et al. | D18/43 |
| 5,548,384 | A * | 8/1996 | Weed | 399/120 |
| D374,456 | S | 10/1996 | Wakatsuki et al. | D18/43 |
| 5,579,101 | A | 11/1996 | Omata et al. | 355/260 |
| 5,870,652 | A | 2/1999 | Kanamori et al. | 399/106 |
| 5,907,756 | A * | 5/1999 | Shirota et al. | 399/262 |
| 6,131,007 | A | 10/2000 | Yamaguchi et al. | 399/256 |
| 6,131,008 | A | 10/2000 | Kanamori et al. | 399/263 |
| 6,289,193 | B1 | 9/2001 | Ban et al. | 399/258 |
| 6,701,112 | B1 * | 3/2004 | Kusano et al. | 399/262 |

* cited by examiner

*Primary Examiner*—Quana Grainger
(74) *Attorney, Agent, or Firm*—Oblon, Spivak, McClelland, Maier & Neustadt, P.C.

(57) ABSTRACT

A developer cartridge, for an image forming apparatus having a shutter, for the delivery of a developer. The developer cartridge includes a body member, at least one delivery opening, and at least one drive lug configured and dimensioned to open and close shutter of an image forming apparatus. The body member is configured to store a developer and defines first and second ends and a longitudinal axis. The delivery opening is configured to dispense developer. The drive lug extends radially outwardly from the body member and is longitudinally aligned with at least some portion of the delivery opening, wherein the drive lug is configured and dimensioned to open and close a shutter of an image forming apparatus.

38 Claims, 6 Drawing Sheets

Initial Cartridge Insertion into Developer Unit

Cartridge In Position to Discharge Toner

DEVELOPER CARTRIDGE INCLUDING RADIALLY EXTENDING DRIVE LUG

BACKGROUND OF THE INVENTION

1. Field of the Invention

The present invention relates to a developer cartridge for an image forming apparatus, and more particularly to a developer cartridge including one or more features that are configured to open and close the shutter of the image forming apparatus.

2. Description of the Related Art

In a known image forming apparatus, such as a facsimile machine, a photocopying machine, a printer, and the like, toner is consumed during multiple image forming processes to form toner images on recording sheets. A known toner cartridge (e.g., a first toner cartridge) is inserted into the image forming apparatus. The toner cartridge is manually rotated in a first direction, such that a first projection on the toner cartridge contacts and displaces a corresponding portion of a shutter to thereby open the shutter. The manual rotation also aligns an opening of the toner cartridge with the opening of the image forming apparatus. During the image forming processes, toner is delivered from the toner cartridge to the opening of the image forming apparatus and is consumed to form the images on the sheets.

Eventually, the toner is fully exhausted from the first toner cartridge. The toner cartridge is manually rotated in a second direction, which is opposite to the first direction, such that a second projection of the toner cartridge contacts and displaces a different corresponding portion of the shutter to thereby close the shutter. The exhausted first toner cartridge is removed from the image forming apparatus, and a second toner cartridge, which includes toner, is then inserted into the image forming apparatus.

The known toner cartridge have a number of design and operational characteristics. During insertion and removal, they are required to be rotated by approximately 90° to operate a shutter. Because separate, multiple projections are required (i.e., the first projection to open the shutter of the image forming apparatus and the second projection to close the shutter), manufacture of the known toner cartridge is complicated. Thus, manufacturing costs of the known toner cartridge are thereby increased. Further, the disposition of the multiple projections as axial extensions of the toner cartridge may complicate alignment of the projections with the shutter of the image forming apparatus. Further, the axially extending projections may be prone to damage and breakage during shipping and/or during use of the known toner cartridge.

BRIEF SUMMARY OF THE INVENTION

The present invention is directed to a developer cartridge that engages with a shutter of an image forming apparatus for the delivery of a developer. As used herein, "developer" includes toner, inks, and the like. In one embodiment, the developer cartridge comprises a body member, a delivery opening, and at least one drive lug configured and dimensioned to open and close the shutter of an image forming apparatus. The body member is configured to store a developer and defines a longitudinal axis. At least one delivery opening extends substantially along the longitudinal axis of the body member. The drive lug extends radially outwardly from the body member, and is longitudinally aligned with at least some portion (width) of the delivery opening.

The developer cartridge of the present invention may require reduced rotation during insertion and removal.

In an alternative embodiment, the developer cartridge also includes a rim that comprises an extension of a periphery, wherein the rim is configured to open and close the shutter of an image forming apparatus cooperatively with at least one drive lug extending radially outwardly from the body member.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein.

DETAILED DESCRIPTION OF PREFERRED EMBODIMENTS

Figure 1:
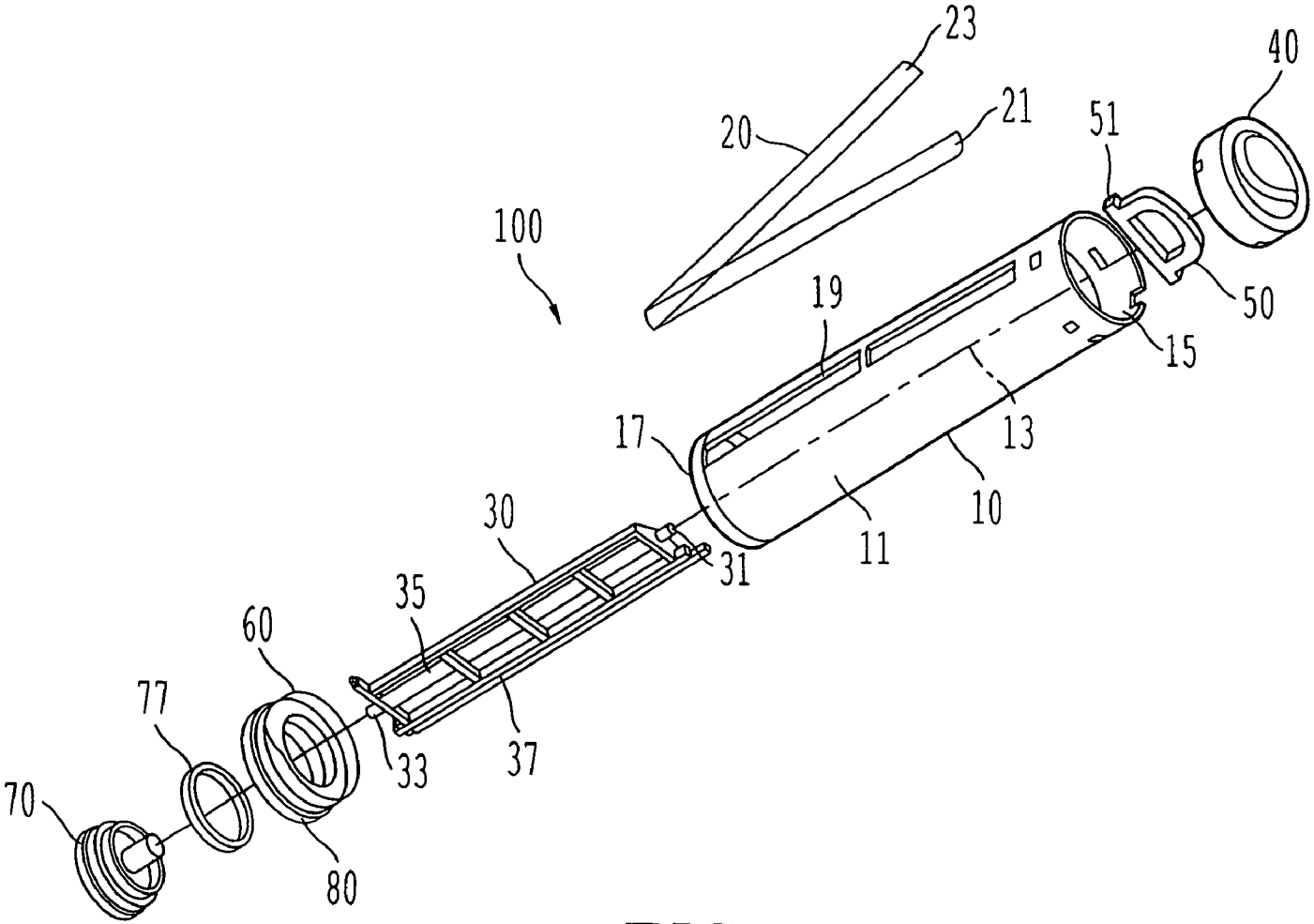
FIG. 1 shows an exploded isometric view of a developer cartridge according to the present invention.
Figure 2A:
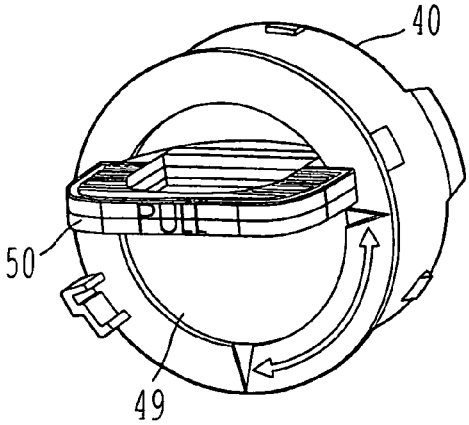
FIGS. 2A and 2B show detail isometric views of a first flange member and an extended and a retracted handle member of the developer cartridge of FIG. 1.
Figure 2B:
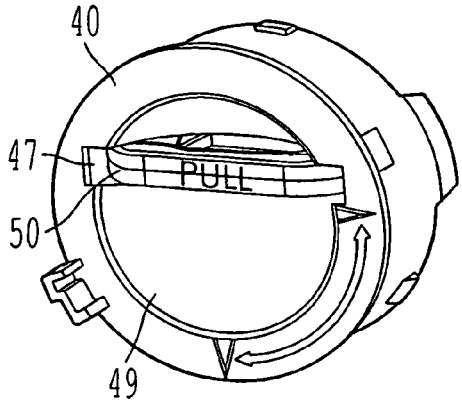
Figure 3:
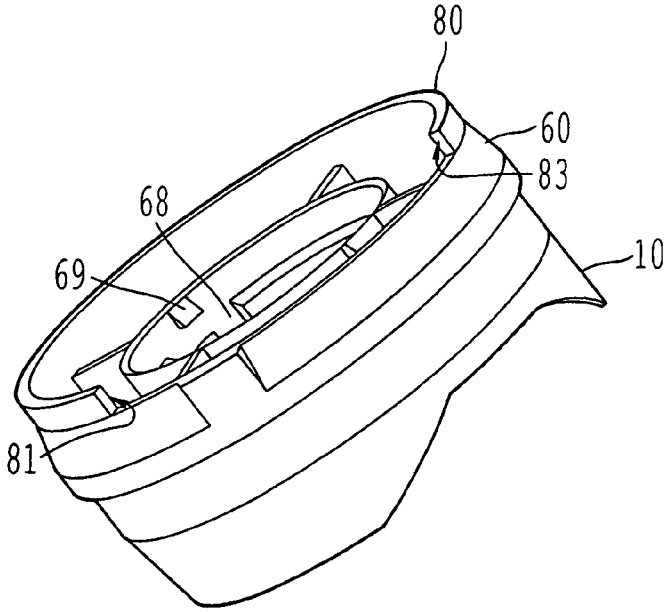
FIG. 3 shows a detail isometric view of a second flange member and a rim of the developer cartridge of FIG. 1.

Examples of preferred embodiments of the present invention will now be described with reference to the drawings, wherein like reference numbers throughout the several views identify like and/or similar elements.

The present invention is directed to a developer cartridge for an image forming apparatus. In one embodiment, the developer cartridge of the present invention can include a drive lug configured to open and to close a shutter of the image forming apparatus. Thus, the developer cartridge of the present invention does not require multiple projections to open and to close the shutter.

In one embodiment of the invention, as shown in the figures, a developer cartridge 100 can include a body member 10, a sealing member 20, a stirring member 30, a first flange member 40, a handle member 50, a second flange member 60, a drive cap 70, a gasketing member 77, and a rim 80 that can be configured to open and to close the shutter of the image forming apparatus. Although the drawings show preferred embodiments of the developer cartridge 100, it is to be understood that the developer cartridge 100 can include various structural elements or configurations, as long as the developer cartridge 100 can include the rim 80 to open and to close the shutter.

During installation in the image forming apparatus, the developer cartridge 100 can be rotated in a first direction, such that the rim 80 can contact and can displace a portion of the shutter of the image forming apparatus to thereby open the shutter. The developer cartridge 100 can be rotated in a second direction, which can be the same as or opposite to the first direction, such that the rim 80 can contact and can displace a portion of the shutter to thereby close the shutter.

As shown in the figures, the body member 10 can define an at least a partially closed volume configured to store a developer (e.g., a single or multiple component toner) therein and to deliver the stored developer to the opening of the image forming apparatus. Although the drawings show preferred embodiments of the body member 10, it is to be understood that the body member 10 can have various arrangements, as long as the body member 10 can define the at least partially closed volume to store and to deliver the developer.

The body member 10 can include a sidewall 11 that extends along an axis 13. The sidewall 11 can define a first open end 15 and a second open end 17 that is opposite to the first open end 15, as well as a developer delivery opening 19. The sidewall 11 can have a cross section that is one or more of a variety of shapes including, but not limited to, a circle, an ellipse, an oval, a polygon, or any combination of one or more of these shapes. In a preferred embodiment of the invention, the sidewall 11 can have a cross section that is circular in shape, such that the sidewall 11 can define a cylinder having a hollow interior portion.

Preferably, a longitudinal length of the sidewall 11 along the axis 13 can be between about 160 mm and about 400 mm and more preferably can be between about 180 mm and about 330 mm, and still more preferably can be between about 200 mm and about 310 mm. Further, a radius of the hollow interior portion, and thus a radius of an interior face of the sidewall 11, can be between about 10 mm and about 70 mm, and more preferably can be between about 15 mm and about 35 mm, and still more preferably can be between about 25 mm and about 30 mm.

The first and second open ends 15, 17, can be disposed along the axis 13. In a preferred embodiment of the invention, either or both of the first and second open ends 15, 17, can have a cross section that is circular in shape. Portions of the sidewall 11 adjacent the first and second open ends 15, 17, can include openings to receive portions of the first and second flange members 40, 60, respectively.

A stirring member holding or receiving portion can be disposed adjacent the first open end 15. The stirring member holding or receiving portion can further close the at least partially closed volume. In a preferred embodiment of the invention, the stirring member holding and receiving portion can be in the form of a webbing defining a void to hold or receive an end of the stirring member 30.

The developer delivery opening 19 can be configured to deliver the stored developer in the developer cartridge 100 to the opening of the image forming apparatus. The developer delivery opening 19 can extend in any direction relative to the axis 13, can be spaced any distance or no distance from one or both of first and second open ends 15, 17, can have a cross section that is one or more of a variety of shapes including, but not limited to, a circle, an ellipse, an oval, a polygon, or any combination of one or more of these shapes, and can include a plurality of sub-openings, as long as the developer delivery opening 19 can deliver the stored developer to the opening of the image forming apparatus. In a preferred embodiment of the invention, the developer delivery opening 19 can extend along the axis 13, can be spaced from both the first and second open ends 15, 17, and can have two sub-openings with cross sections that are about rectangular in shape.

In a preferred embodiment of the invention, the body member 10 can be manufactured from materials including resin materials (e.g., ABS. and/or polystyrene). Further, the body member 10 can be manufactured by processes including an injection molding process, an extrusion process, and/or a cooling core type process to size an interior portion of the body member 10. The developer delivery opening 19 and/or the openings adjacent the first and second open ends 15, 17, of the sidewall 11 can be formed by a material removal operation after manufacturing of the sidewall 11.

The sealing member 20 can prevent developer leakage from the at least partially closed volume through the developer delivery opening 19 prior to removal of the sealing member 20 from the body member 10. The sealing member 20 can be connected to the sidewall 11 of the body member 10 to cover the developer delivery opening 19. Although the drawings show preferred embodiments of the sealing member 20, it is to be understood that the sealing member 20 can be of various types, including that of a known or conventional type, as long as the sealing member 20 can prevent developer leakage through the developer delivery portion 19.

In a preferred embodiment of the invention, the sealing member 20 can be in the form of a flexible film. The sealing member 20 can have a length at least twice a length of the developer delivery opening 19.

A first portion 21 of the scaling member 20 can be connected to the body member 10 to cover the developer delivery opening 19. A second portion 23 of the sealing member 20 can be connected to the first portion 21, such that a force applied to the second portion 23 is transferred to the first portion 21 to thereby disconnect the sealing 5 member 20 from the body member 10 and to uncover the developer delivery portion 19.

In a preferred embodiment of the invention, the first portion 21 can be connected to the body member 10 such that a force required to disconnect the first portion 21 from the body member 10 is preferably between 0.1 kgf to 10 kgf. Further, the first portion 21 can be connected to the body member 10 by manufacturing processes including hot plate fusing, impulse sealing, ultrasonic wave fusing, and/or high frequency fusing. The sealing member 20 can be manufactured from materials including, but not limited to, polyester resin, Nylon, polyethylene resin, and/or ethylene vinyl acetate. The sealing member 20 can have a thickness of between about 70 microns and about 200 microns, and more preferably between about 100 microns and about 150 microns, and still more preferably between about 108 and 122 microns.

The stirring member 30 can be configured to stir the stored developer in the body member 10 and to deliver the stored developer from the body member 10 through the developer delivery opening 19 to the opening of the image forming apparatus. Although the drawings show preferred embodiments of the stirring member 30, it is to be understood that the stirring member 30 can have any arrangement, including that of a known or conventional type, as long as the stirring member 30 can stir and deliver the developer to the opening of the image forming apparatus.

The stirring member 30 can include a first end 31 that can be disposed in the stirring member holding or receiving portion adjacent the first open end 15 and a second end 33 that can be driven by the drive cap 70 disposed in the second flange member 60, the second flange member 60 disposed in the second open end 17 of the body member 10. The first and second ends 31, 33, can be connected to a stirring member shaft 35, and the stirring member shaft 35 can be connected to one or more stirring blades 37. By this arrangement, rotation of the stirring member 30 can stir and deliver the developer. In a preferred embodiment of the invention, the first end 31 of the stirring member 30 can be disposed in the stirring member holding or receiving portion adjacent the first open end 15 prior to disposing the second flange member 60 and the drive cap 70 in the body member 10.

The first flange member 40 can be can be disposed in the first open end 15. The first flange member 40 can include voids and/or protrusions configured to cooperate with corresponding features of the sidewall 11, such as the opening adjacent the first open end 15, or alternatively can be formed during a formation (e.g., an injection molding) of the body member 10, Although the drawings show preferred embodiments of the first flange member 40, it is to be understood that the first flange member 40 can have various arrangements.

In a preferred embodiment of the invention, the first flange member 40 can be manufactured from materials including resin materials (e.g., ABS and/or polystyrene). The first flange member 40 can include a handle member receiving opening 47 configured to receive the handle member 50. The handle member receiving opening 47 can be formed in the first flange member 40 during formation of the first flange member 40 (e.g., during an injection molding of the first flange member 40), and/or can be formed by a separate and subsequent material removal operation.

In a preferred embodiment of the invention, the handle member receiving opening 47 can extend from a top face of the first flange member 40 to a bottom face of the first flange member 40, such that insertion of the handle member 50 into the handle member receiving opening 47 can be achieved from an interior of the developer cartridge 100 and/or from an interior of the first flange member 40. The handle member receiving opening 47 can be sized, shaped, and/or oriented so as to correspond with those aspects of the handle member 50, such that the handle member 50 can be extended and retracted.

The handle member 50 can be disposed in the handle member receiving opening 47, and can be configured to be used for rotation of the developer cartridge 100 in the image forming apparatus. The handle member 50 can be configured such that the handle member 50 can be moved in a direction about parallel to the axis 13, such that the handle member 50 can be extended for the rotation of the developer cartridge 100, and can be retracted. Thus, although the drawings show certain preferred embodiments of the handle member 50, it is to be understood that the handle member 50 can be of a variety of shapes and types, as long as the handle member 50 can be extended and retracted in the direction along the axis 13.

In a preferred embodiment of the invention, the handle member 50 can include handle member stops 51 configured to cooperate with portions of the first flange member 40 adjacent the handle member receiving opening 47, such that removal of the handle member 50 from the first flange member 40 without deformation (i.e., elastic and/or plastic) and/or breakage of the first flange member 40 and/or the handle member 50 can be prohibited. The first flange member 40 can include a recessed portion 49, such that extension and/or retraction of the handle member 50 can be facilitated. By this arrangement, the handle member 50 can be configured such that an outermost portion of the handle member 50 can be about flush with an outermost face of the first flange member 40 when the handle member 50 is retracted.

The second flange member 60 can be disposed in the second open end 17 of the body member 10 to further close the at least partially closed volume. The second flange member 60 can include voids and/or protrusions configured to cooperate with corresponding features of the sidewall 11, such as the opening adjacent the second open end 17. Although the drawings show preferred embodiments of the second flange member 60, it is to be understood that the second flange member 60 can have various arrangements, including that of a known or conventional type, as long as the second flange member 60 can further close the at least partially closed volume. The drive cap 70 can include a stirring member holding or receiving 15 portion that can define a stirring member bore. The stirring member holding or receiving portion can be configured to support the stirring member 30, such that the second end 33 of the stirring member 30 can be disposed in the stirring member bore.

The second flange member 60 can define a developer receiving opening 68 configured to receive the developer from an outside developer source (e.g., a bulk developer source, such as a toner bottle) for storage in the developer cartridge 100. The developer receiving opening 68 can have a cross section that is in one or more of a variety of shapes including, but not limited to, a circle, an ellipse, an oval, a polygon, or any combination of one or more of these shapes, and can be disposed at any position on the second flange member 60. In a preferred embodiment of the invention, the developer receiving opening 68 can have a cross section that is about circular in shape, and can be disposed at a center of the second flange member 60.

In a preferred embodiment of the invention, a cross sectional area of the developer receiving opening 68 is preferably between about 30% to 80% of the cross sectional area of the second open end 17, and more preferably between 40% to 70%. Further, one or both of the developer receiving opening 68 and the stirring member holding or receiving portion of the second flange 60 can be disposed such that receipt of the developer through the developer receiving opening 68 can be satisfactorily accomplished.

In a preferred embodiment of the invention, the second flange member 60 can be manufactured from materials including resin materials (e.g., ABS and/or polystyrene). The second flange member 60 can be manufactured by processes including an injection molding process.

The drive cap 70 can be configured to be disposed in the developer receiving opening 68 of the second flange member 60, such that leakage of the developer through the developer receiving opening 68 can be prevented, and such that driving of the stirring member 30 can be accomplished through driving of the second end. Although the drawings show certain preferred embodiments of the drive cap 70, it is to be understood that the drive cap 70 can be of various types, as long as the drive cap 70 can be disposed in the developer receiving opening 68 to prevent leakage of the developer.

In a preferred embodiment of the invention, the drive cap 70 can be non-removably retained in the developer receiving opening 68. In this context, non-removably retained can be defined to include that attempted and/or successful removal of the drive cap 70 can result in damage to at least some portion of the developer cartridge 100. Examples of damage to the developer cartridge 100 can include elastic deformation, plastic deformation, and/or breakage of a portion of the sidewall 13, the second flange member 60, and/or the drive cap 70. In a preferred embodiment of the invention, methods for preventing removal of the drive cap 70 from the developer receiving opening 68 can include, but are not limited to, achievement of an interference fit therebetween and/or mechanical fastening techniques (e.g., adhesion), Preferably, the interference fit can be achieved by disposing at least a portion of a side wall of the drive cap 70 below a locking tab 69 of the second flange member 60, and more preferably by disposing the side wall of the drive cap 70 below two locking tabs 69. The drive cap 70 can be manufactured from materials including low and/or high density polyethylene, and/or polypropylene.

A gasketing member 77 can be disposed between the developer receiving opening 68 of the second flange member 60 and a portion of the drive cap 70, and can prevent a leakage of developer therebetween. Optionally, the gasketing member 77 can be omitted from the developer cartridge 100.

The rim 80 can be configured to open and to close the shutter of the image forming apparatus, such that the developer stored in the developer cartridge 100 can be delivered to the image forming apparatus. In a preferred embodiment of the invention, the developer cartridge 100 can be inserted into the image forming apparatus. The developer cartridge 100 can be rotated (e.g., manually) such that the rim 80 can contact and can displaces a corresponding portion of the shutter to thereby open the shutter. The developer cartridge 100 can be rotated (e.g., manually) in a second direction (e.g., either opposite to or in a same direction as the first direction), such that the rim 80 can contact and can displace a corresponding portion of the shutter (e.g., a same portion or a different portion as contacted during the opening of the shutter) to thereby close the shutter. Although the drawings show preferred embodiments of the rim 80, it is to be understood that the rim 80 can have any arrangement, as long as the rim 80 can open and can close the shutter of the image forming apparatus.

The rim 80 can be disposed on the second flange member 60. In a preferred embodiment of the invention, the rim 80 can be formed by an extension of a periphery of the second flange member 60, and can be formed during a manufacture of the second flange member 60. As shown in the drawings, the rim can include first and second faces 81, 83, each configured to perform one of the opening and the closing of the shutter. Preferably, the rim 80 can be formed as an extension of an outer circumference of the second flange member 60, and can encompass an arc of at least about 180 degrees between the first and second faces 81, 83, and more preferably can encompass an arc of about 245 degrees between the first and second faces 81, 83. In a preferred embodiment of the invention, that can be used with a known image forming apparatus, the first face 81 can be used to close the shutter of the known image forming apparatus, and the second face 83 can be used to open the shutter.

Further, the rim 80 can be in various forms. For example, the rim 80 can have a single or multiple thicknesses along an arcuate portion. One or both of the first and second faces 81, 83, can extend towards and/or away from the axis 13.

Alternative locations for the rim 80 can include, but are not limited to, a variety of positions on the first flange member 40 and the drive cap 70. Further, the rim 80 can be disposed at any position on the second flange member 60. Additionally, the first and second faces 81, 83, can be disposed at any position on, and/or in any orientation relative to, the rim 80.

The rim 80 can be produced by various manufacturing processes, including extrusion of a full peripheral portion and/or as part of an injection molded component, and subsequent material removal to form the first and second faces 81, 83, or alternatively extrusion of a periphery and the first and second faces 81, 83 (e.g., without subsequent material removal). Production of the rim 80 can be simplified as compared to the manufacture of multiple projections on a known toner cartridge, as a more complicated manufacturing process, tooling, and/or mold may be required for the known toner cartridge.

Further, the disposition of the rim 80 on an end portion (i.e., as a radial extension) of the developer cartridge 100 can provide numerous advantages, such as a more positive alignment and/or engagement with the shutter of the image forming apparatus. Further, the radially extending rim 80 can be less susceptible to breakage during shipping and/or during use of the developer cartridge 100.

Figure 4:
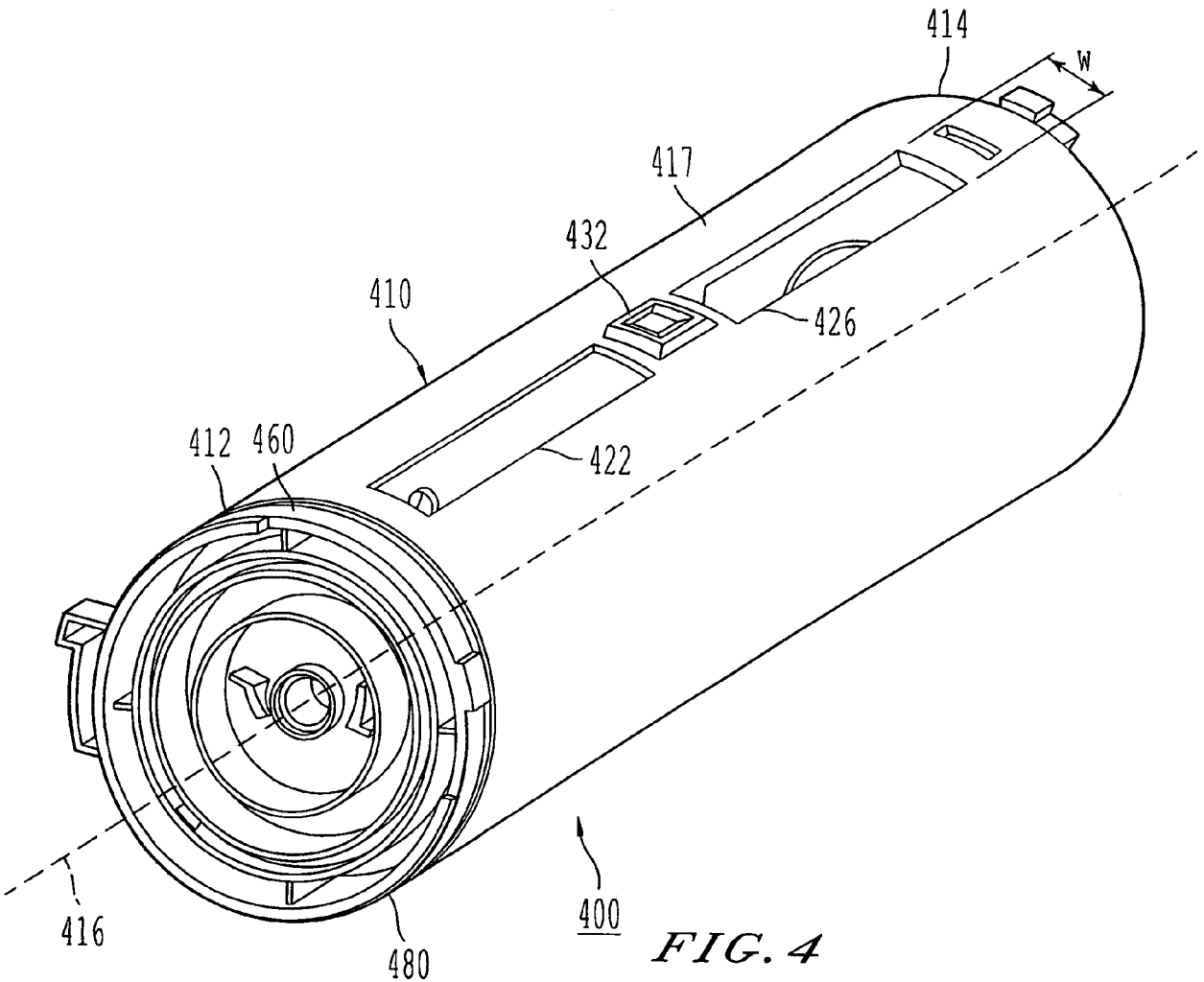
FIG. 4 shows a perspective view of the developer cartridge of the present invention with a single radially outwardly extending drive lug for opening and closing a shutter of an image forming apparatus.
Figure 5:
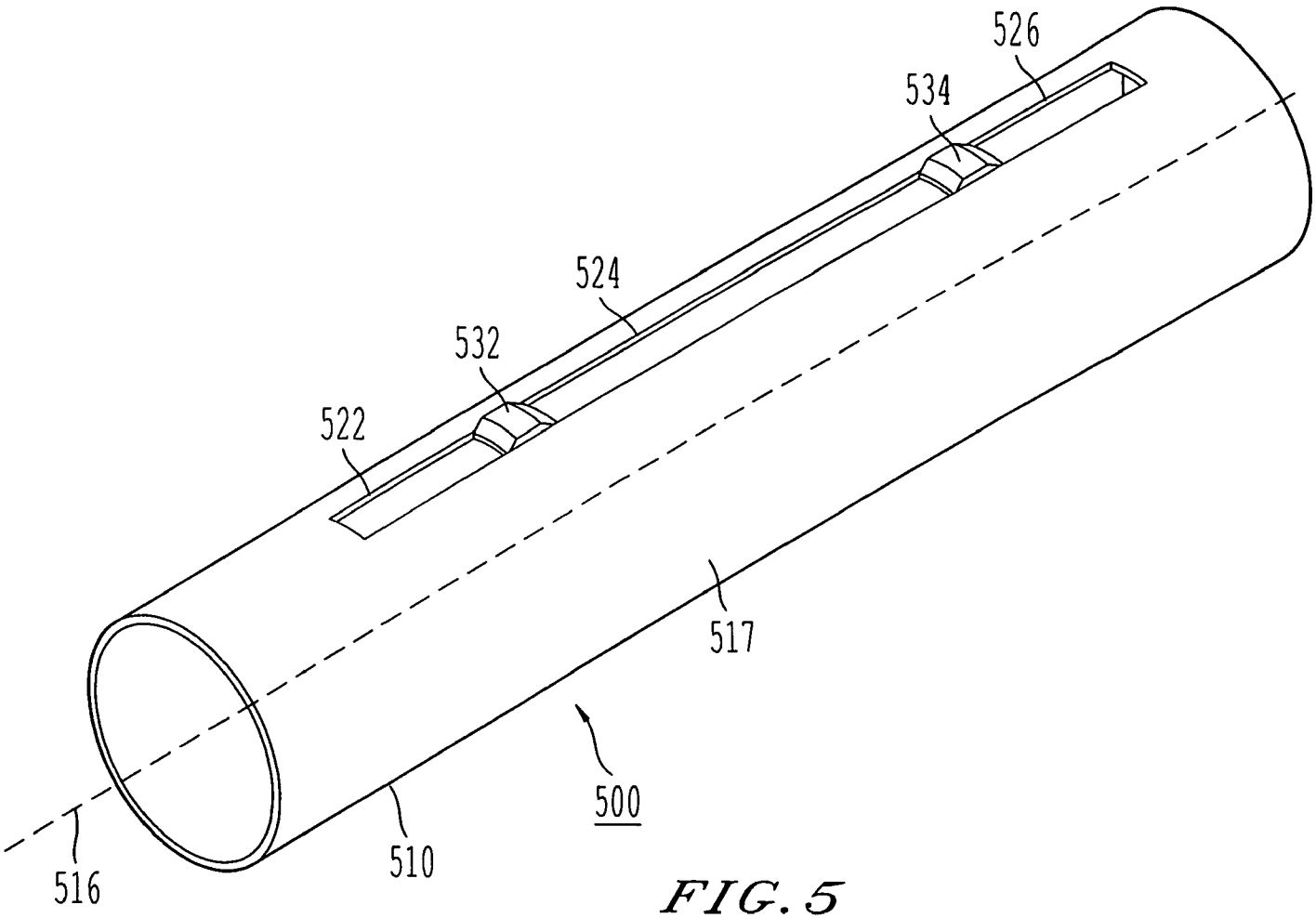
FIG. 5 shows an isometric view of an alternative embodiment of the developer cartridge of the present invention having a plurality of radially outwardly extending drive lugs for opening and closing a shutter of an image forming apparatus.

Turning now to FIGS. 4 and 5, a second aspect of the present invention is directed to a developer cartridge 400, 500 having an alternate, or supplementary, means for opening and closing the shutter of an image forming apparatus.

As shown in FIG. 4, in one embodiment, the delivery cartridge 400 comprises a body member 410 configured to store a developer. The body member 410 defines first and second ends 412, 414 extending along a longitudinal axis 416 and an outer surface 417. The embodiment shown in FIG. 4 further comprises two elongated delivery openings 422, 426 formed through the surface 417 of the body member 410. Each of the elongated delivery openings 422, 426 extend substantially along the longitudinal axis 416 of the body member 410. As discussed above, the delivery opening can also extend in other directions relative to the axis 416, can be spaced any distance from the first and second ends 412, 414, and can have a cross-section that is comprised of one or more of a variety of shapes so long as there is a sufficient delivery opening to deliver the stored developer. While the embodiment of FIG. 4 illustrates two developer openings 422, 426, the delivery openings are not limited to a particular number, and as discussed below, can comprise a single delivery opening. At least one drive lug 432 extends radially outwardly from the outer surface 417 of the body member 410.

The drive lug 432 is longitudinally aligned with at least some portion of at least one delivery opening, 422, 426. Viewed another way, at least some portion of the drive lug 432 is circumferentially located within a circumferential width w of at least one delivery opening 422, 426. And, as seen in FIG. 4, the drive lug 432 is circumferentially located entirely within the circumferential width w of the at least one delivery opening. And because the drive lug 432 is roughly at the same circumferential position as the delivery opening, a developer cartridge of the present invention requires less than 90° of rotation to operate a shutter during insertion and removal, and preferably between 70° and 80°.

While the drive lug 432 may be formed of any suitable material, for manufacturing simplicity the drive lug 432 will be manufactured from the same resin material (i.e. ABS plastic and/or polystyrene) as the body member 410. The drive lug 432 may be integrally formed via injection molding, extrusion, etc. with the body member 410 so as to be formed from one continuous piece of material, or alternatively, may be separately formed and bonded or fastened to the body member 410. The drive lug 432 is further configured and dimensioned to open and to close the shutter of the image forming apparatus, such that the developer stored in the cartridge 400, 500 can be delivered to the image forming apparatus.

In addition to the radially outwardly extending drive lug 432, the developer cartridge 400, 500 may comprise a supplementary, or auxiliary, means for opening and closing the shutter of an image forming apparatus. Returning to FIG. 4, the cartridge 400 may also comprise a rim 480 as described in detail above, which in an extension of the periphery of flange 460.

Referring specifically to FIG. 5, an alternative embodiment of the developer cartridge 500 is shown. This embodiment is illustrative of a cartridge 500 having a plurality of developer openings 522, 524, 526, and a plurality of drive lugs 532, 534 that are formed in the same manner as described above.

Figure 6:
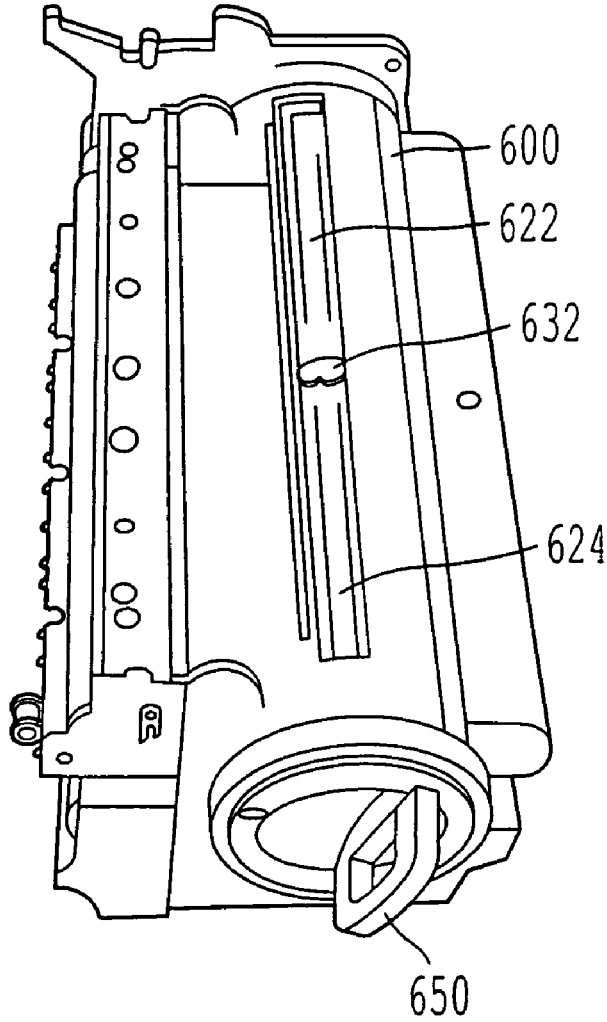
FIG. 6 shows a side perspective view of the developer cartridge of the present invention as inserted in a developer unit.
Figure 7:
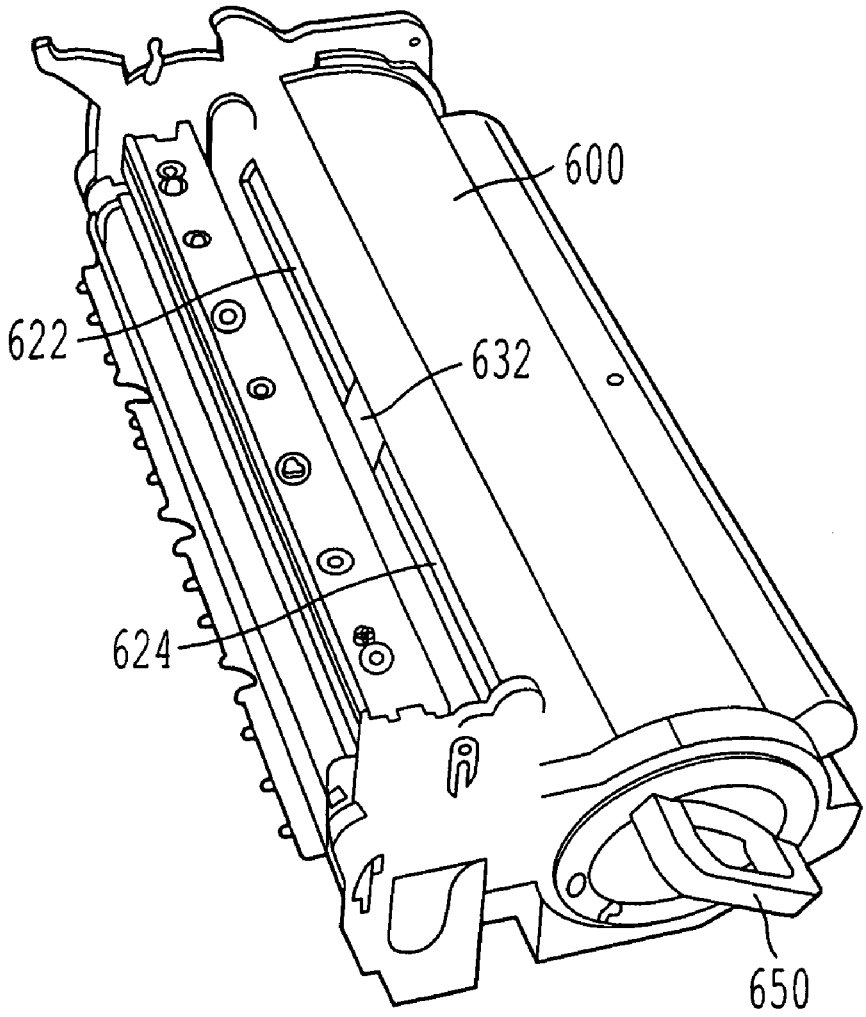
FIG. 7 shows a side perspective view of the developer cartridge of the present invention with the shutter open for discharge of the developer.

Referring to FIGS. 6 and 7, the operation of the developer cartridge 400, 500 is illustrated. As illustrated in FIG. 6, a cartridge developer 600 is shown inserted into the image forming apparatus. In the embodiment of FIG. 6, a single drive lug 632 is shown between the two delivery openings 622, 624. The drive lug 632 is configured and dimensioned to open and to close the shutter of the image forming apparatus. When handle 650 is rotated in a first direction, as shown in FIG. 7, the drive lug 632 engages the shutter so that the cartridge 600 is in position to discharge developer to the image forming apparatus. Conversely, the handle 650 is rotated in a second direction to cause drive lug 632 to close the shutter so that the cartridge 600 can be removed from the unit and replaced.

Numerous additional modifications and variations of the present invention are possible in light of the above teachings. It is therefore to be understood that within the scope of the appended claims, the present invention may be practiced otherwise than as specifically described herein.

I claim:

1. A developer cartridge, for an image forming apparatus having a shutter, comprising:

(a) a body member configured to store a developer, the body member defining first and second ends and having a longitudinal axis;

(b) at least one delivery opening formed in said body member configured to dispense developer, said at least one delivery opening having a first end and a second end;

(c) a first drive lug extending radially outwardly from the body member, the first drive lug being longitudinally aligned with at least some portion of the delivery opening, wherein the first drive lug is configured and dimensioned to open and close a shutter of an image forming apparatus; and (d) a second drive lug extending radially outwardly from the body member, the second drive lug being longitudinally aligned with at least some portion of the delivery opening, wherein the second drive lug is configured and dimensioned to open and close the shutter in conjunction with the first drive lug.

2. A developer cartridge, for an image forming apparatus having a shutter, comprising:

(a) a body member configured to store a developer, the body member defining first and second ends and having a longitudinal axis;

(b) at least one delivery opening formed in said body member configured to dispense developer, said at least one delivery opening having a first end and a second end; and (c) at least one drive lug extending radially outwardly from the body member, the at least one drive lug being longitudinally aligned with at least some portion of the delivery opening, wherein the at least one drive lug is configured and dimensioned to open and close a shutter of an image forming apparatus, wherein the at least one drive lug is formed within the delivery opening between the first and second ends.

3. A developer cartridge, for an image forming apparatus having a shutter, comprising:

(a) a body member configured to store a developer, the body member defining first and second ends and having a longitudinal axis;

(b) at least one delivery opening formed in said body member configured to dispense developer, said at least one delivery opening having a first end and a second end; and (c) at least one drive lug extending radially outwardly from the body member, the at least one drive lug being longitudinally aligned with at least some portion of the delivery opening, wherein the at least one drive lug is configured and dimensioned to open and close a shutter of an image forming apparatus, wherein the body member comprises a plurality of delivery openings extending along the longitudinal axis of the body member.

4. The developer cartridge of claim 3, wherein the at least one drive lug is disposed between at least two of the plurality of delivery openings.

5. The developer cartridge of claim 3, wherein the body member has at least three elongated delivery openings extending along the longitudinal axis, and at least one drive lug between each pair of adjacent delivery openings.

6. The developer cartridge of claim 1, wherein at least one of the first and second drive lugs is integrally formed with the body member.

7. The developer cartridge of claim 1, wherein at least one of the first and second drive lugs is fastened to the body member.

8. A developer cartridge, for an image forming apparatus having a shutter, comprising:

(a) a body member configured to store a developer, the body member defining first and second ends and having a longitudinal axis;

(b) at least one delivery opening formed in said body member configured to dispense developer, said at least one delivery opening having a first end and a second end; and (c) at least one drive lug extending radially outwardly from the body member, the at least one drive lug being longitudinally aligned with at least some portion of the delivery opening, wherein the at least one drive lug is configured and dimensioned to open and close a shutter of an image forming apparatus, wherein the at least one drive lug is circumferentially located entirely within a circumferential width of the at least one delivery opening.

9. A developer cartridge, for an image forming apparatus having a shutter, comprising:

(a) a body member configured to store a developer, the body member defining first and second ends and having a longitudinal axis;

(b) at least one delivery opening formed in said body member configured to dispense developer, said at least one delivery opening having a first end and a second end;

(c) at least one drive lug extending radially outwardly from the body member, the at least one drive lug being longitudinally aligned with at least some portion of the delivery opening, wherein the at least one drive lug is configured and dimensioned to open and close a shutter of an image forming apparatus; and (d) a rim comprising an extension of a periphery, wherein the rim is configured to open and to close the shutter of an image forming apparatus cooperatively with the at least one drive lug.

10. The developer cartridge of claim 9, wherein the at least one drive lug is formed within the delivery opening between the first and second ends.

11. The developer cartridge of claim 9, wherein the body member comprises a plurality of delivery openings extending along the longitudinal axis of the body member.

12. The developer cartridge of claim 11, wherein the at least one drive lug is disposed between at least two of the plurality of delivery openings.

13. The developer cartridge of claim 11, wherein the body member has at least three elongated delivery openings along the longitudinal axis of the body member, and at least one drive lug between each pair of adjacent delivery openings.

14. The developer cartridge of claim 9, wherein the at least one drive lug is integrally formed with the body member.

15. The developer cartridge of claim 9, wherein the at least one drive lug is fastened to the body member.

16. The developer cartridge of claim 9, wherein the at least one drive lug is circumferentially located entirely within a circumferential width of the at least one delivery opening.

17. The developer cartridge according to claim 9, wherein the rim comprises first and second faces disposed on opposite ends of an extended portion, the first and second faces configured to open and to close the shutter.

18. The developer cartridge according to claim 17, wherein the first face is configured to open the shutter, and the second face is configured to close the shutter.

19. The developer cartridge according to claim 17, further comprising first and second flange members, wherein the rim is disposed on one of the first and second flange members.

20. The developer cartridge according to claim 19, wherein the rim comprises an extension of an outer circumference of the one of the first and second flange members.

21. The developer cartridge according to claim 20, wherein the rim encompasses an arc of at least about 180 degrees.

22. The developer cartridge according to claim 21, wherein the rim encompasses the arc of about 245 degrees.

23. The developer cartridge according to claim 19, wherein the rim extends from the one of the first and second flange members along an axis of the body member, the first and second faces are disposed perpendicular to the axis of the body member, and the rim has one of a constant thickness and a variable thickness along the arc and first and second faces extending toward an to axis of the body member.

24. The developer cartridge according to claim 19, wherein the rim is disposed on the second flange member.

25. The developer cartridge according to claim 19, further comprising a drive cap disposed in a receiving void of the second flange member, the receiving void configured to receive a developer from a bulk developer source.

26. The developer cartridge according to claim 25, wherein the drive cap is non-removably retained in the second flange member.

27. The developer cartridge according to claim 26, wherein at least one of the drive cap and the second flange member comprises locking tabs to retain the drive cap in the second flange member.

28. The developer cartridge according to claim 26, wherein at least one of the drive cap and the second flange member comprises a plurality of locking tabs to retain the drive cap in the second flange member.

29. The developer cartridge according to claim 28, wherein a sidewall of the receiving void comprises at least two locking tabs to retain the drive cap in the second flange member.

30. The developer cartridge according to claim 29, further comprising a stirring member configured to stir a developer stored in the body member.

31. The developer cartridge according to claim 9, further comprising a handle member disposed in one of the first and second flange members, the handle member configured to be extended and retracted along an axis of the body member.

32. The developer cartridge according to claim 31, wherein the handle member is disposed in a handle member receiving opening in the one of the first and second flange members.

33. The developer cartridge according to claim 32, wherein the handle member comprises a handle member stop configured to prevent removal of the handle member from the one of the first and second flange members without deformation of the handle member and the one of the first and second flange members.

34. The developer cartridge according to claim 32, wherein the handle member comprises two handle member stops configured to prevent removal of the handle member from the one of the first and second flange members without deformation of the handle member and the one of the first and second flange members.

35. The developer cartridge according to claim 34, wherein the handle member is disposed in the first flange member, and the first flange member comprises a recessed portion configured to facilitate one of extension and retraction of the handle member.

36. The developer cartridge according to claim 1, wherein the at least one delivery opening comprises three delivery opening, and the first drive lug is disposed between two of the delivery openings.

37. The developer cartridge according to claim 36, wherein one of the delivery openings is disposed between the first and second drive lugs.

38. The developer cartridge according to claim 37, wherein the second drive lug is disposed between two of the delivery openings.

* * * * *